US005361662A

United States Patent [19]

Levy

[11] Patent Number: 5,361,662

[45] Date of Patent: Nov. 8, 1994

[54] MOVING HYDRAULIC PRESS

[75] Inventor: Roger Levy, Bloomfield Hills, Mich.

[73] Assignee: Tishken Products Co., Oak Park, Mich.

[21] Appl. No.: 208,260

[22] Filed: Mar. 8, 1994

Related U.S. Application Data

[63] Continuation of Ser. No. 974,141, Nov. 10, 1992, abandoned.

[51] Int. Cl.[5] ..... B26D 1/60

[52] U.S. Cl. ..... 83/308; 83/314; 83/319

[58] Field of Search ..... 83/308, 314, 318, 319, 83/468.5

[56] References Cited

U.S. PATENT DOCUMENTS

| | | | |
|---|---|---|---|
| 2,163,967 | 6/1939 | Strawn et al. | 83/319 X |
| 2,488,205 | 11/1949 | Kopczynski | 83/468.5 X |
| 3,322,011 | 5/1967 | Kocian | 83/314 X |
| 3,442,167 | 5/1969 | Ohmasu | 83/319 X |
| 3,656,385 | 4/1972 | Kimbrell | 83/319 X |
| 4,394,829 | 7/1983 | Stoehr | 83/314 X |
| 4,727,783 | 3/1988 | John, Jr. | 83/308 X |

*Primary Examiner*—Rinaldi I. Rada
*Attorney, Agent, or Firm*—Dykema Gossett

[57] ABSTRACT

A hydraulic press comprises a hydraulic drive for driving a die surface towards and away from a moving workpiece. The die surface and the hydraulic drive both move with the workpiece on rails. This is an improvement over prior art systems where only the die surface would move with the workpiece. In another aspect of the present invention a plurality of pickups also move with the hydraulic press. These pickups engage apertures in the workpiece to properly align cutting elements on the die with the workpiece. A control selectively actuates certain ones of the plurality of pickups to allow one to quickly change the size of elements formed by the die.

12 Claims, 8 Drawing Sheets

MOVING HYDRAULIC PRESS

This is a of copending application(s) Ser. No. 07/974,141 filed on Nov. 10, 1992, now abandoned.

BACKGROUND OF THE INVENTION

This invention relates to improvements in hydraulic presses for working on a moving workplace.

In the prior art, hydraulic presses are known for forming apertures in, or cutting, a workplace. Typically, the hydraulic press includes a high-force hydraulic drive which forces a first surface downwardly towards a workplace. When such press is used with a moving workplace, a sliding surface is engaged by that first surface. Punches on the sliding surface are forced downwardly by the first surface. The sliding surface moves with a moving coil of material as it is forced downwardly, and slides relative to the hydraulic drive as it moves. Since the hydraulic drive is applying a very high pressure to that sliding surface, the sliding creates an undue amount of friction and noise. Further, since movement of the workplace alone pulls the sliding surface, it is sometimes difficult to achieve sufficient strength to pull the sliding surface against the large downward force.

In the prior art, punches on the sliding surface are typically positioned relative to the workplace by engaging a pickup alignment member with an aperture in the workplace. This pickup is spaced from the punches such that the apertures formed by the punches are properly spaced from the aperture which receives the pickup. In the prior art, a single pickup was utilized and was adjustable relative to the hydraulic press to control the length of the part. When one desired to change the length of the part one was required to shut the line down and move the pickup along a rail. This was undesirably time-consuming and inefficient.

SUMMARY OF THE INVENTION

In the disclosed embodiment of the present invention, the entire hydraulic press slides along rails with the moving workpiece. It is not necessary for a portion of the press to slide relative to a non-moving portion. This reduces friction and noise over the prior art. In a most preferred embodiment of this invention, a hydraulic die base, hydraulic drive, and cylinder all slide with the moving workpiece. Preferably pillow slide blocks are received on Thompson-type bearing rails which allow relatively low friction sliding movement. A spring preferably returns the hydraulic die to its original point once apertures are properly formed in the workpiece.

In another aspect of the present invention, a plurality of pickup members are positioned adjacent to the hydraulic press and selectively engage apertures formed in the workpiece to properly position the hydraulic press relative to the workpiece. In the inventive combination, a control actuates selected ones of the pickups to control the distance between the apertures which receive the pickup and the cutting elements on the hydraulic press. One can thus change the length of the parts formed by the hydraulic press by merely selectively actuating the proper pickup. This is an improvement over the prior art which required one to manually reposition a single pickup unit.

In a further preferred embodiment of the invention, at least two laterally-spaced apertures are formed on the workpiece to selectively receive a pickup unit. The pickup system includes laterally-spaced but partially aligned pickups, with one of the two pickups selectively engaging one of the two apertures formed in the part. In this way, one can gain fine control over the distance between the pickups and the hydraulic press.

In another embodiment of the present invention, a plurality of hydraulic press units may move as a single unit, and may be selectively actuated such that only certain ones of the plurality of units are utilized to punch a particular workpiece. This is valuable when, for instance, one is cutting serial notches in a particular workpiece, and the particular workpiece has a varying length. One may selectively actuate certain ones of the plurality of hydraulic presses to form the desired number of apertures in the particular workpiece.

These and other objects and features of the present invention can be best understood from the following specification and drawings, of which the following is a brief description.

DETAILED DESCRIPTION OF A PREFERRED EMBODIMENT

Figure 1A:
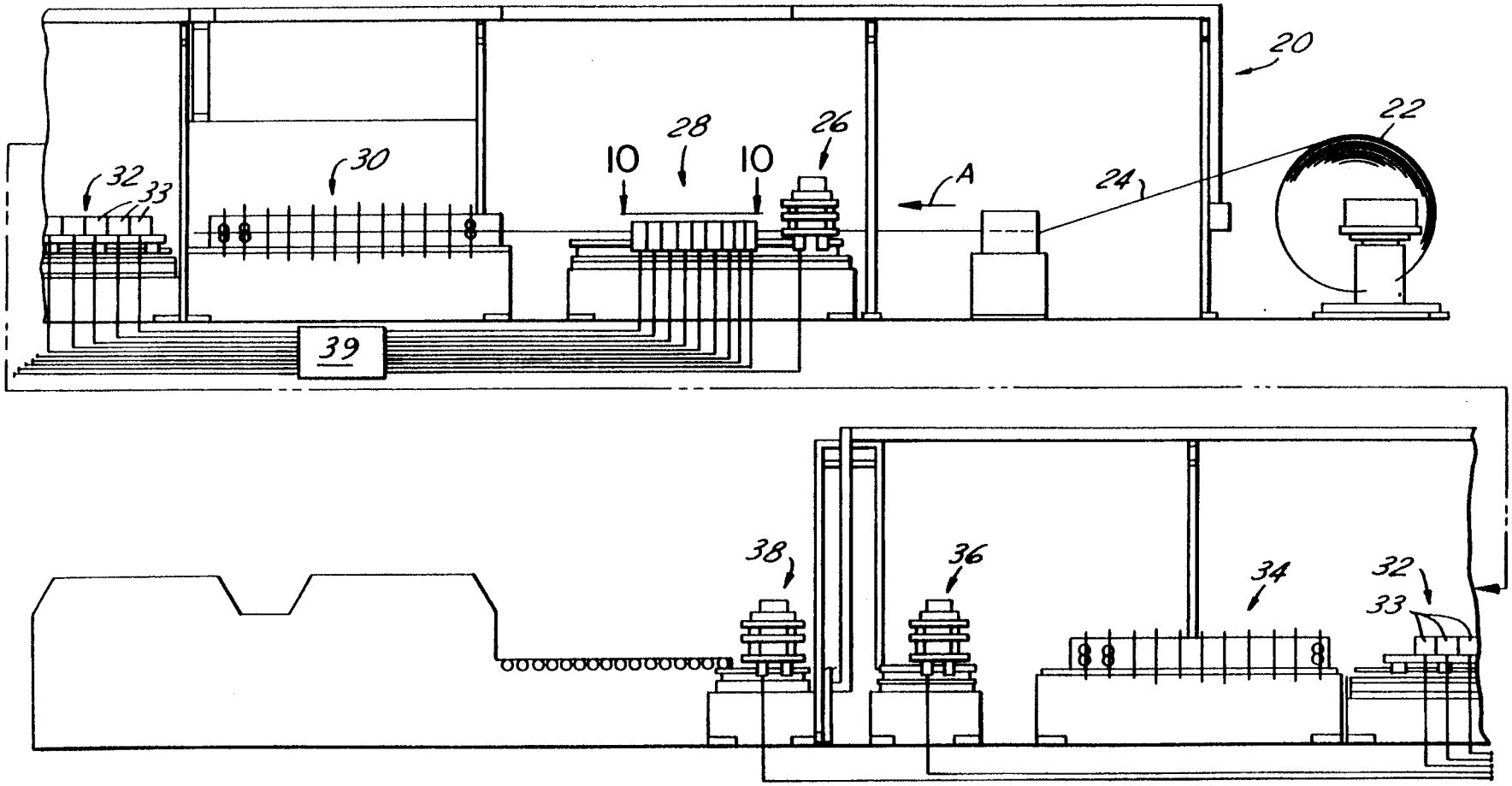
FIG. 1A is a schematic view of a die system incorporating the present invention.

As shown in FIG. 1A, a roll-forming machine 20 includes a coil 22 dispensing a moving sheet metal workpiece 24 through a hydraulic press or section 26, and into a pickup system 28 which properly positions the hydraulic press 26 relative to the moving workpiece 24. As is known, a roll-forming station 30 pulls the moving workpiece 24 through sections 26 and 28. A hydraulic press combination or section 32 is positioned downstream of section 30, and another roll-forming section 34 is positioned downstream of the hydraulic press 32. Finally, two hydraulic press sections 36 and 38 are positioned downstream of roll-forming section 34 to finally notch and cut a part. It should be understood that this particular combination of sections is shown as an example only. The shape of a particular part to be formed will dictate the arrangement and number of sections.

The invention in the present application is directed to hydraulic presses and pickups such as sections 26, 28, 32, 36 and 38. Sections 26, 36 and 38 all disclose single hydraulic presses wherein the entire hydraulic press slides on rails with the moving workpiece. Section 28 discloses a unique pickup system for properly positioning section 26 relative to workpiece 24. Section 32 includes a plurality of selectively actuatable movable hydraulic presses.

Figures 1B, 2:
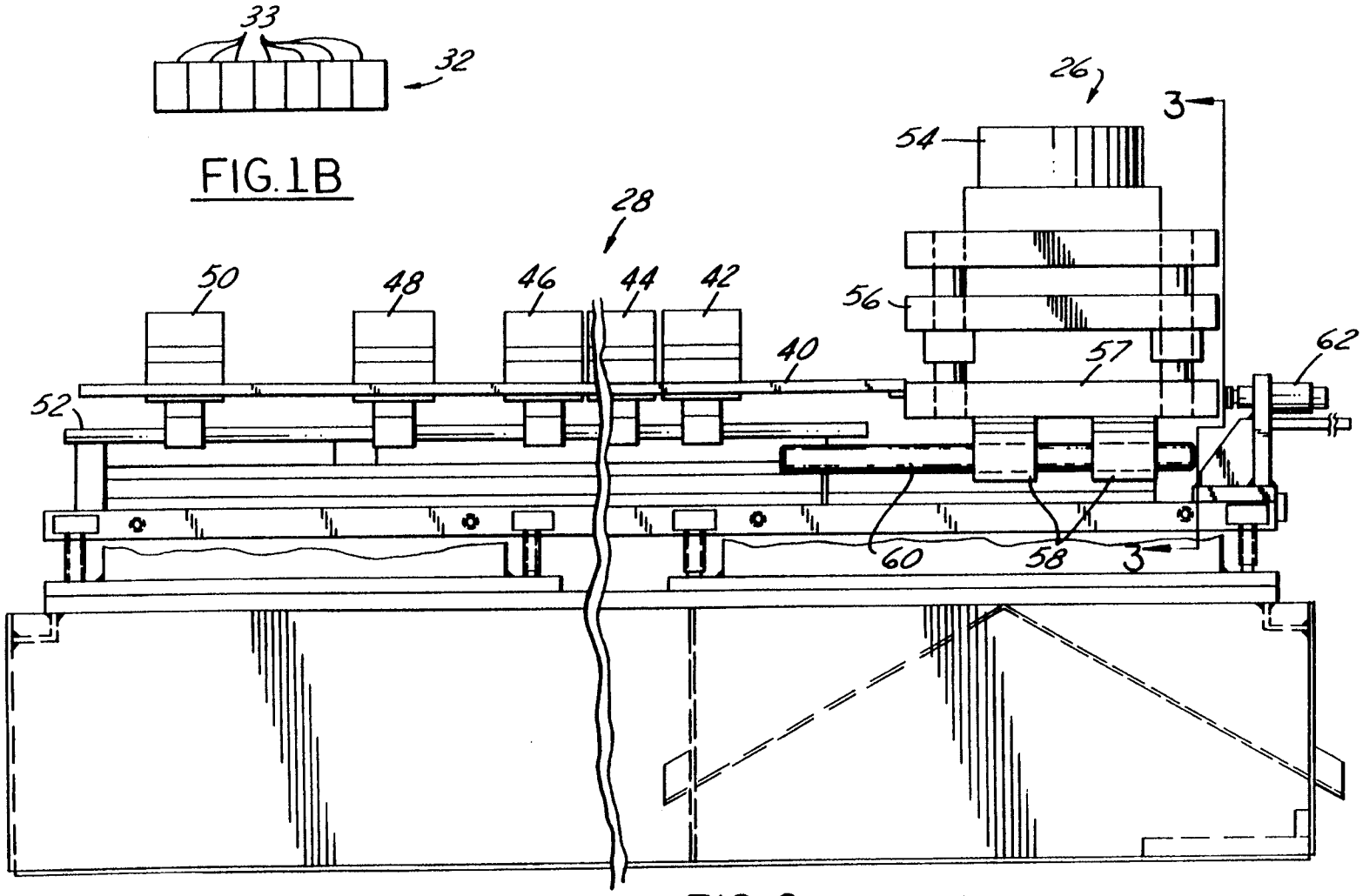
FIG. 1B is a highly schematic view of one portion of the die system.
FIG. 2 is an enlarged view of portions of the die system shown in FIG. 1A.

FIG. 1B is a schematic view of hydraulic press section 32. As shown, a plurality of individual hydraulic presses 33 are spaced along the path A of movement of workpiece 24. A computer controller 39 for section 32 selectively actuates desired ones of presses 33. The entire assembled plural presses 33 will move as a unit with the workpiece 24 in a manner which will be described below with reference to section 26. Any means of connecting the hydraulic presses 33 may be utilized. If one were forming workpiece sections having a plurality of serially-spaced apertures, and the length of that workpiece section is changed, thereby changing the number of serially-spaced apertures required for the particular part, one may form those apertures by selectively actuating certain of the plurality of presses 33. In one embodiment there were forty-eight (48) selectively actuatable presses 33.

As shown in FIG. 2, section 26 consists of a cylinder 54 selectively driving a ram 56 towards and away from a workpiece. A base 57 is positioned beneath ram 56. Pillow block bearings 58 slide on a rail 60 in a manner to be described below. A connection arm 40 connects a pickup assembly 28 to move with the hydraulic press or section 26. Pickup assembly 28 consists of a plurality of selectively actuatable pickups 42, 44, 46, 48 and 50. All of the pickup assemblies slide along a rail 52.

As a workpiece moves along its path A, the entire hydraulic press 26 including the cylinder 54, the ram 56 and the base 57 move along with the moving workpiece. Further, the pickup assembly 28 moves along with the hydraulic press 26. Each of the pickups is configured as known in the prior art. In such pickups a spring-biased piston 112 is forced downwardly into contact with a surface of the workpiece. That piston is laterally aligned with an aperture 76. Once the aperture 76 becomes axially aligned with the piston 112, the piston is forced into that aperture. The workpiece then drags the pickup along as it moves. As the pickup begins to move, the entire hydraulic press section 26 moves with the workpiece. Further, the entire pickup section 28 also moves with the single engaged pickup. The rails 52 and 60, and the bearing for carrying the pickups and the hydraulic press section 26 are configured to be very low friction. Thus, a low force pulling the roll of moving workpiece 24 through the hydraulic press 26 and pickup assembly 28 is sufficient.

The pickup which is selected to engage the aperture is selected such that the distance between the particular pickup and the cutting surfaces on the hydraulic press 26 is as desired for the particular part. Once the section 26 has punched the part, the pickup is released and the moving workpiece 24 continues to move without sections 26 and 28. As will be described below, a spring 66 then returns the sections 26 and 28 to their original position. A snubber 62 absorbs the return force on sections 26 and 28 as they are returned by the spring 66.

Figure 3:
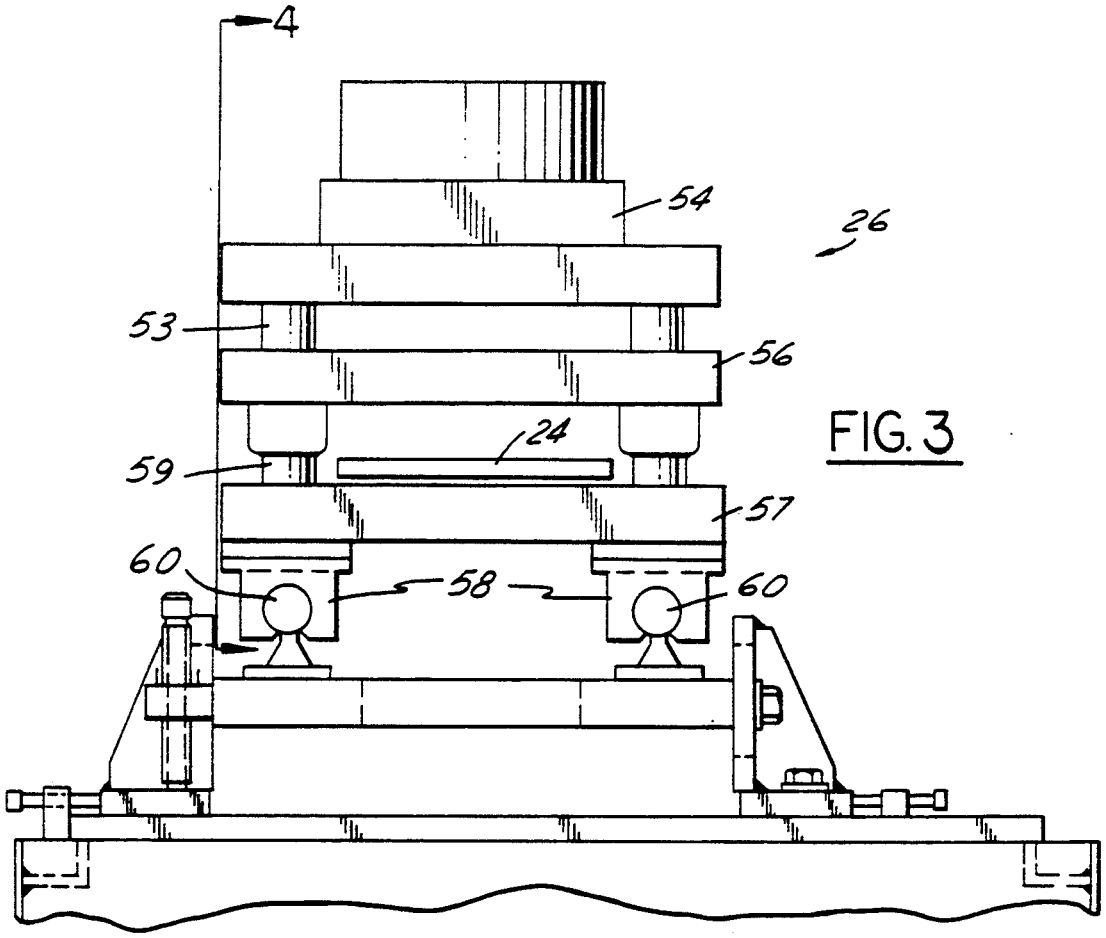
FIG. 3 is a cross-sectional view taken along line 3—3 of FIG. 2.
Figure 4:
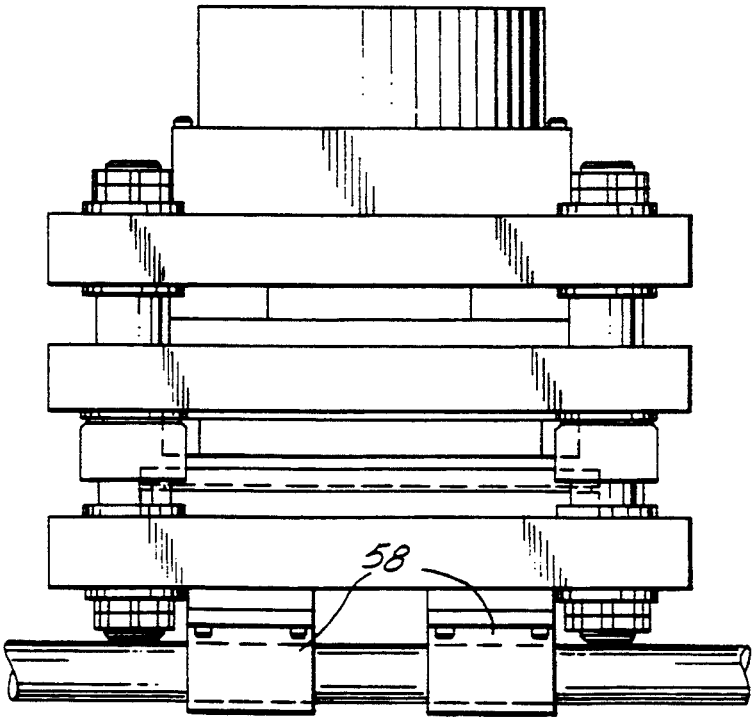
FIG. 4 is a side view of the device looking in the direction of arrows 4—4 of FIG. 3.

As shown in FIG. 3, the cylinder 54 selectively drives a ram 56 through draw bar 53. Workpiece 24 is received between ram 56 and base 57. Ram 56 telescopes on columns 59 fixed to base 57. Pillow block bearings 58 slide on rail 60. Further as shown in FIG. 4, there are two spaced pillow block bearings 58.

Figure 5:
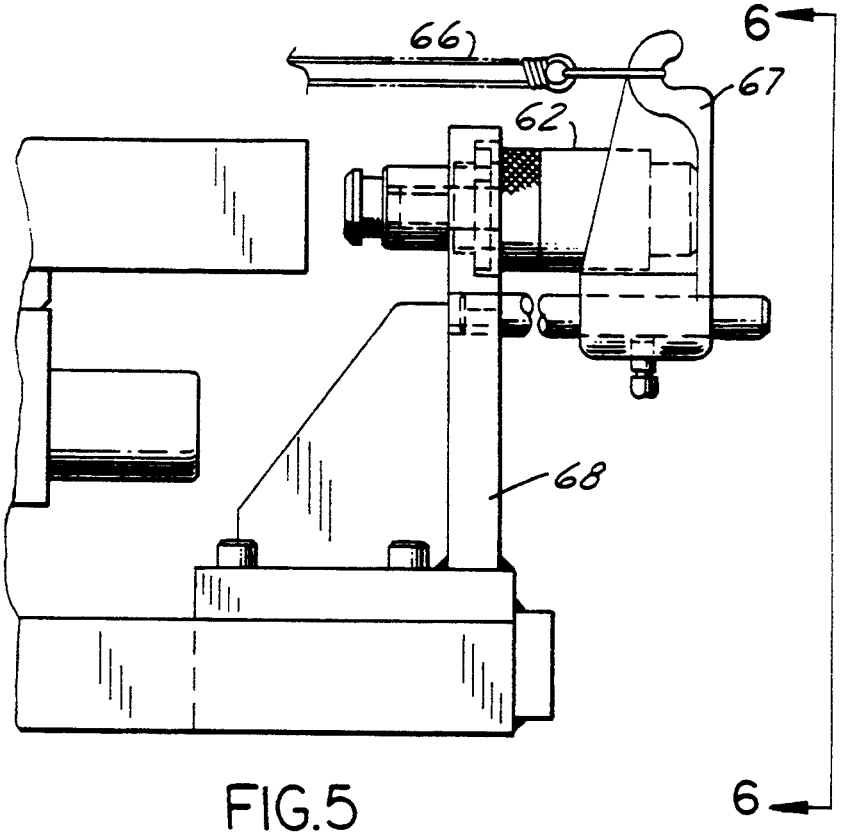
FIG. 5 is an end view of a portion of the die system.
Figure 6:
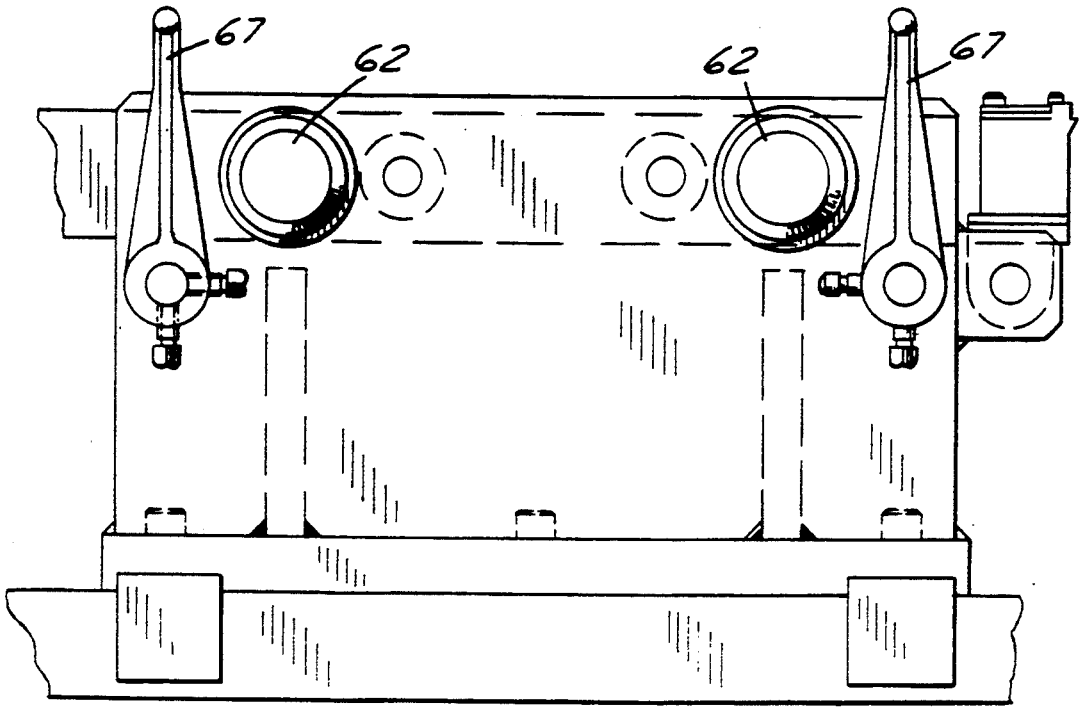
FIG. 6 is an end view taken along line 6—6 of FIG. 5.

FIG. 5 shows return spring 66 which is hooked onto clip or bracket 67 adjacent snubber 62. FIG. 6 shows that there are two spaced clips 67 and snubbers 62.

Figure 7:
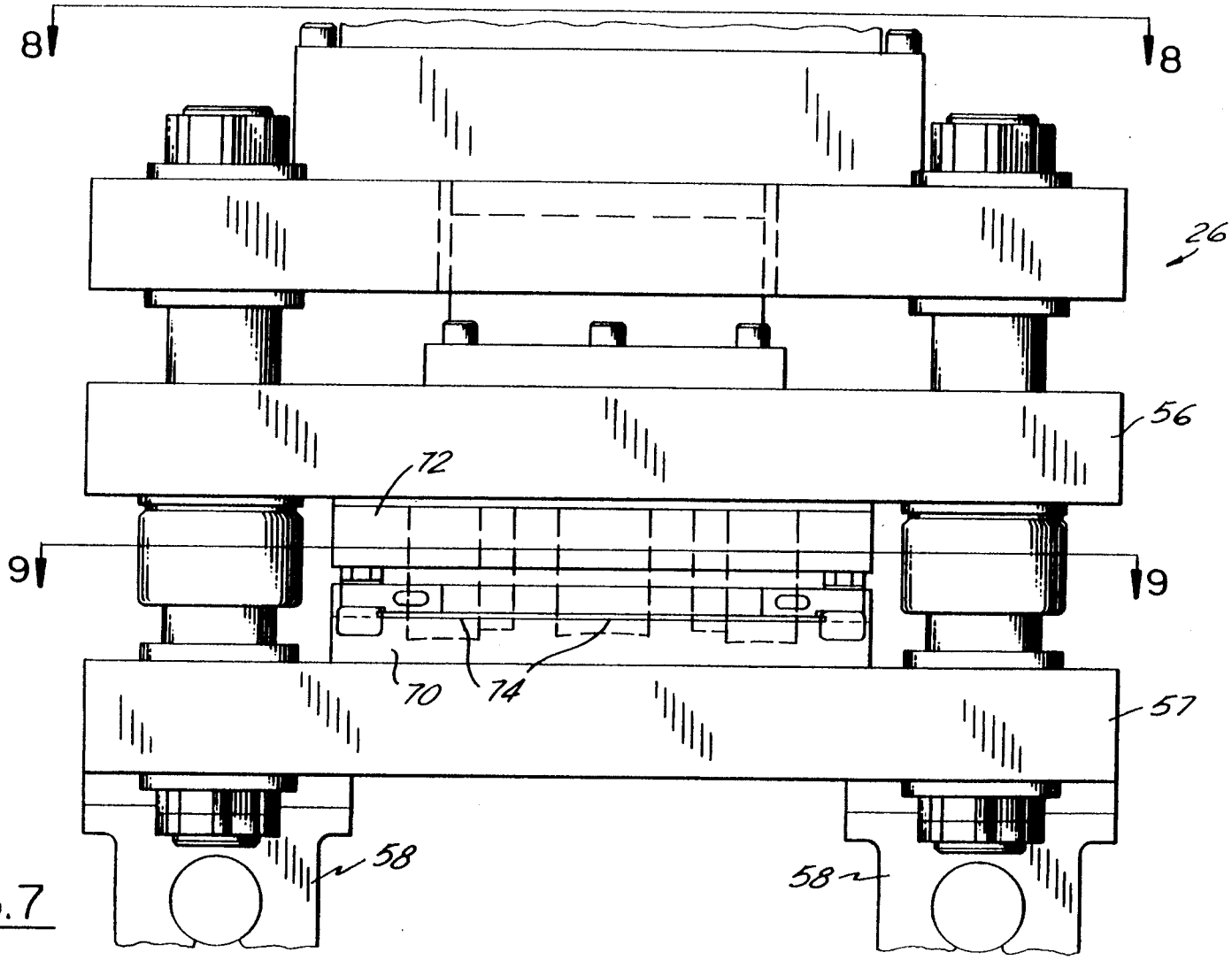
FIG. 7 is a view similar to FIG. 2, but showing a fully assembled die.

FIG. 7 shows an assembled hydraulic die 26. Ram 56 carries a die surface 72 and base 57 carries a die surface 70. Punches 74 move with die surface 72 to form apertures in the workpiece which is received between surfaces 70 and 72.

Figure 8:
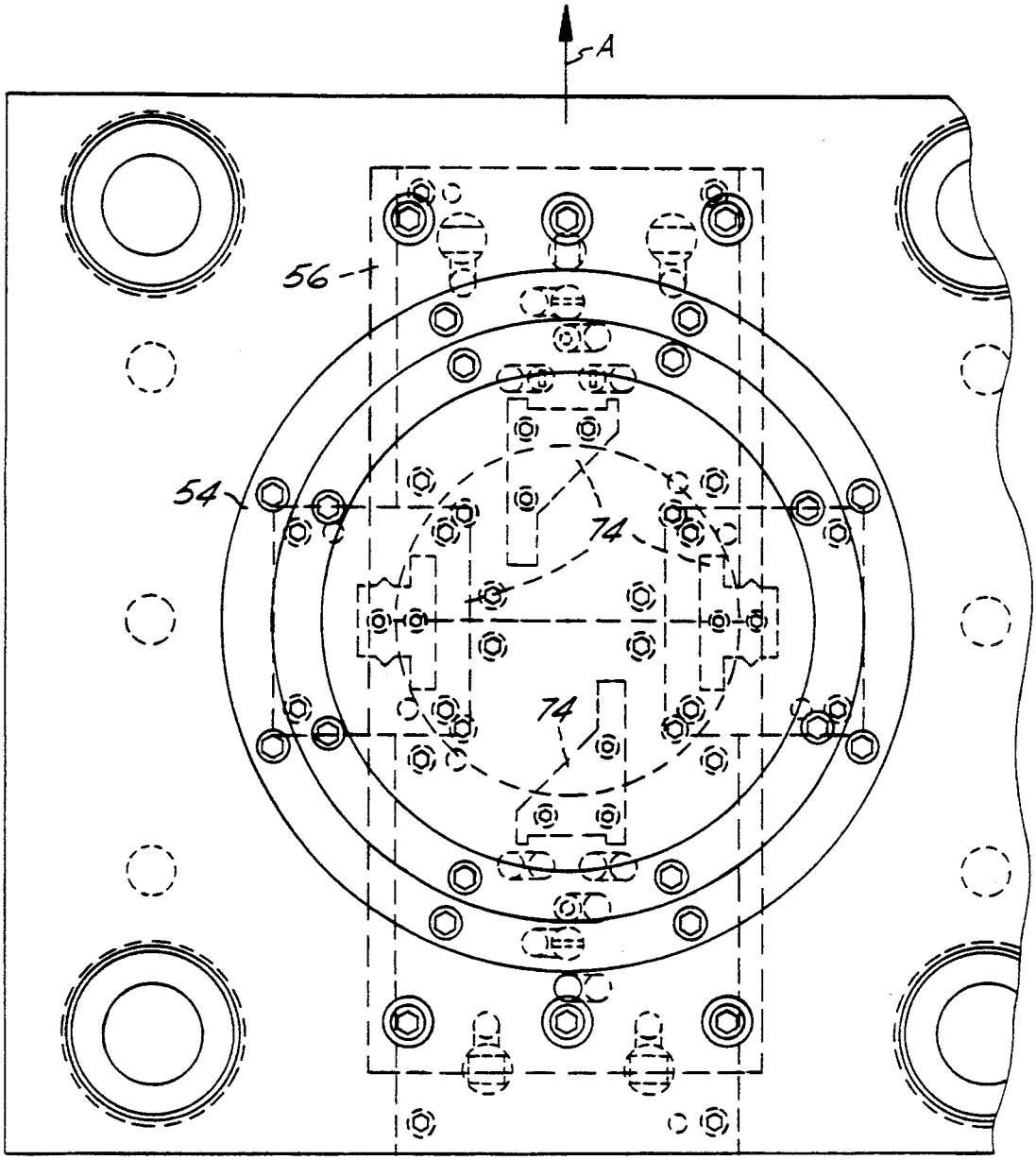
FIG. 8 is a view taken along line 8—8 of FIG. 7.
Figure 9:
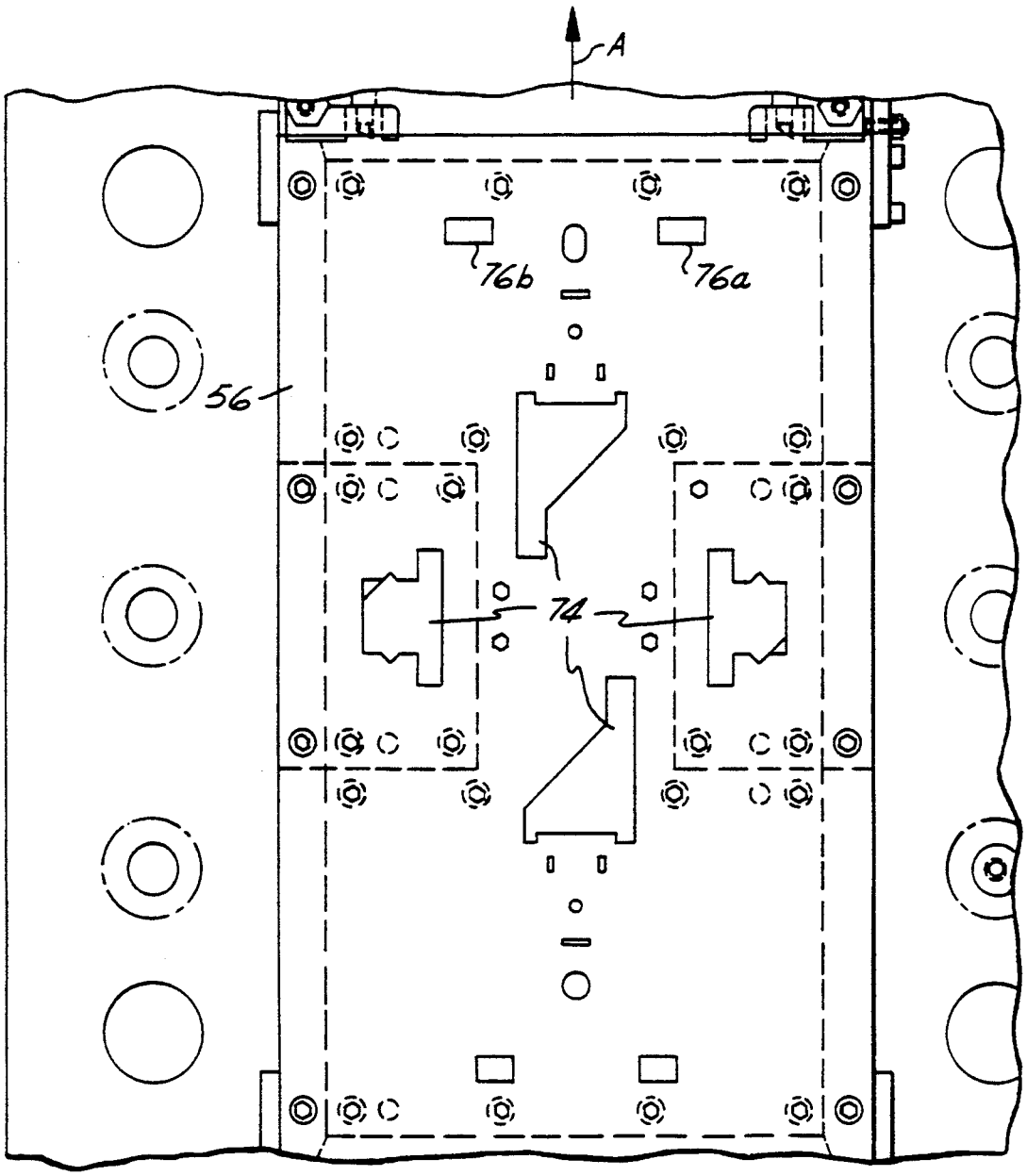
FIG. 9 is a view taken along line 9—9 of FIG. 7.

As shown in FIG. 8, the arrangement of punches 74 is selected to form apertures as desired in the workpiece 24. As shown in FIG. 9, alignment apertures **76*a* and 76*b* may be formed such that there are two alignment apertures 76*a* and 76*b*** which are slightly laterally-spaced transverse to the path A of the material. This allows freedom in the use of the pickup assemblies as will be described below.

Figure 10:
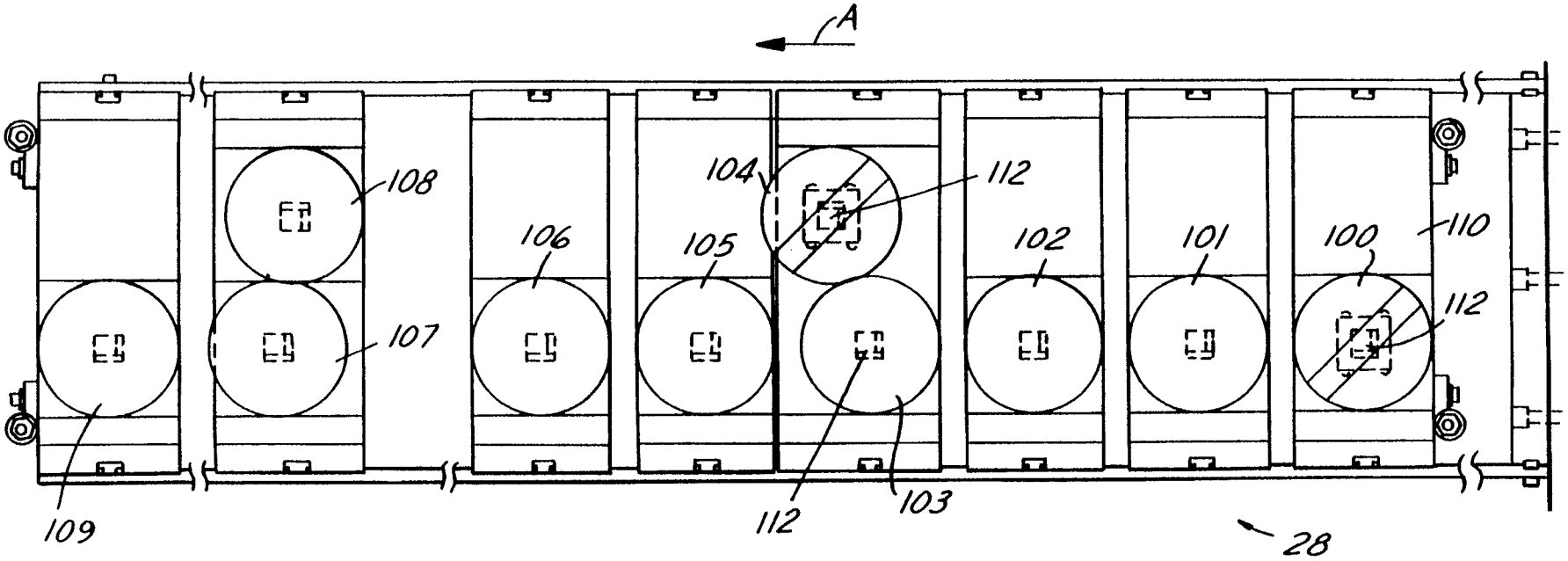
FIG. 10 is a view taken along line 10—10 as shown in FIG. 1A.

As shown in FIG. 10, the pickup section 28 may consist of several pickups spaced along the path of travel of the workpiece 24. Additional pickup sections are shown in this figure over what are shown in the schematic FIG. 1A view. As shown, pickup sections 100, 101, 102, 103, 104, 105, 106, 107, 108 and 109 may be spaced along the path of travel of the workpiece 24. Each of the pickup sections are mounted in mounting sections 110, which move with a frame which slides along the rail, as described above. Each pickup has an alignment piston 112 as is known in the prior art. As is known, a piston 112 may be spring-biased outwardly of the cylinder against a surface of a workpiece 24. Each pickup includes a pneumatic cylinder which holds piston 112 in the cylinder against the force of the spring. When it is desired to utilize a particular pickup, the cylinder is released and the spring forces the piston outwardly to contact the surface of the workpiece. Once piston 112 becomes aligned with an alignment aperture 76, piston 112 moves into the alignment aperture 76. Pickup section 28, and consequently hydraulic die section 26, then begin to move with the moving workpiece 24.

Pickups 104 and 108 are laterally-spaced transverse to the path A of the material from pickups 103 and 107. This allows additional freedom in the length of the part being formed. As is shown, the distance between adjacent pickups 103 and 105 is relatively great. However, the distance between the pistons 112 on sections 103 and 104 is relatively small. This is due to the fact that they are axially overlapped along the path of travel of the workpiece. Piston 112 associated with pickup 104 may engage one alignment aperture **76*a* while piston 112 associated with pickup 103 may engage the other, laterally-spaced, alignment aperture 76*b***.

The computer controller 39 for the pickup section 28 selectively actuates any one of the pickup sections 100–109 to provide a proper spacing between the alignment apertures 76 and the cutting surfaces on the hydraulic press. Thus, should it be desired to have a relatively long part the controller might actuate pickup 109. This would provide a great deal of distance between apertures 76 and 74 formed on the part by the subsequent actuation of the hydraulic press 26. Alternatively, should it be desired to have a relatively small part, pickup 100 may be actuated. The laterally-spaced pickups 103 and 104 allow fine control over this distance, since the center lines of the pistons 112 associated with pickup sections 103 and 104 are spaced by a relatively small distance.

It is preferred that the control 39 for the moving pickups be computer based such that one can easily enter the length of a particular part to be formed, and the pickups will be actuated as proper for that particular part. Further, it is preferred that the computer based control 39 be utilized for section 32. Finally, although details of sections 36 and 38 have not been specifically disclosed, it should be understood that they are similar to section 26 in that they move with the moving workplace 24. Section 38 might comprise a cutting element which cuts the entire part from the roll into discrete parts.

A preferred embodiment of the present invention has been disclosed, however, a worker of ordinary skill in the art would recognize that certain modifications would come within the scope of this invention. For that reason the following claims should be studied in order to determine the true scope and content of this invention.

I claim:

1. A hydraulic press for a moving workpiece comprising:

a die surface movable along an axis normal to a path of movement of a moving workpiece and carrying at least one cutting element, the cutting element having means for cutting an aperture in the moving workpiece;

a base positioned parallel to and aligned with the die surface such that the moving workpiece moves between the base and the die surface;

a plurality of independently selectively actuable pick-ups distributed along the path of movement of the moving workpiece with each pick-up having a piston operably engaging the workpiece by entry into the aperture of the moving workpiece and the pick-ups being slidably mounted for movement with the workpiece when engaged therewith and the die surface being connected to at least one of the pickups for movement therewith;

control means for independently selectively actuating at least two of the pick-ups to engage the workpiece; and press actuating means for moving the die surface along the axis and toward the base to form the aperture in the moving workpiece when the piston of the at least one of the pick-ups is engaged with the moving workpiece.

2. A hydraulic press as claimed in claim 1 further comprising:

a second cutting element being carried by the die surface and having means for cutting an aperture in the moving workpiece and located on the die surface laterally spaced from the first cutting element and also in the path of the moving workpiece; and at least one of the plurality of pick-ups being laterally spaced from the other of the pick-ups and also in the path of the workpiece and operably engaging the workpiece by insertion into the aperture of the moving workpiece formed by the second cutting element.

3. A hydraulic press as claimed in claim 2 wherein the die surface is slidably mounted for displacement along the path of the moving workpiece; and the plurality of pick-ups are fixed with respect to each other and connected to the die surface for unitary displacement along the path of the moving workpiece with the die surface.

4. A hydraulic press as claimed in claim 2 further comprising a rail parallel to the path of movement of the moving workpiece upon which is slidably mounted at least one of the die surface and the plurality of pick-ups.

5. A hydraulic press as claimed in claim 2, wherein the base is connected to the die surface for movement therewith along the path of movement of the moving workpiece.

6. A hydraulic press as claimed in claim 2 further comprising a spring disposed between a stationary bracket and the die surface and adapted to urge the die surface and the plurality of pick-ups back to an upstream position relative to the moving workpiece after the cutting elements have cut the moving workpiece.

7. A hydraulic press as claimed in claim 2 wherein a computer comprises the control means.

8. A hydraulic press as claimed in claim 1 wherein the die surface is slidably mounted for displacement along the path of the moving workpiece; and the plurality of pick-ups are fixed with respect to each other and connected to the die surface for unitary displacement along the path of the moving workpiece with the die surface.

9. A hydraulic press as claimed in claim 1 further comprising a rail parallel to the path of movement of the moving workpiece upon which is slidably mounted at least one of the die surface and the plurality of pick-ups.

10. A hydraulic press as claimed in claim 1, wherein the base is connected to the die surface for movement therewith along the path of movement of the moving workpiece.

11. A hydraulic press as claimed in claim 1 further comprising a spring disposed between a stationary bracket and the die surface and adapted to urge the die surface and the plurality of pick-ups back to an upstream position relative to the moving workpiece after the cutting element has cut the moving workpiece.

12. A hydraulic press as claimed in claim 1 wherein a computer comprises the control means.

* * * * *